US005977956A

United States Patent [19]

Gerrard

[11] Patent Number: 5,977,956

[45] Date of Patent: Nov. 2, 1999

[54] VARIABLE VOLTAGE CONTROLLERS

[76] Inventor: Jeff Gerrard, 51, Prospero Way, Hartford, Huntingdon, Cambridgeshire, PE18 7PQ, United Kingdom

[21] Appl. No.: 08/737,583

[22] PCT Filed: May 18, 1995

[86] PCT No.: PCT/GB95/01112

§ 371 Date: Nov. 18, 1996

§ 102(e) Date: Nov. 18, 1996

[87] PCT Pub. No.: WO95/31817

PCT Pub. Date: Nov. 23, 1995

[51] Int. Cl.[6] ..... G09G 5/00

[52] U.S. Cl. ..... 345/174; 345/156; 345/173; 84/733; 341/11; 364/480

[58] Field of Search ..... 345/174, 173, 345/177, 178, 156; 178/18, 19; 341/11; 364/480; 84/733, 741, 602

[56] References Cited

U.S. PATENT DOCUMENTS

| | | | |
|---|---|---|---|
| 3,778,769 | 12/1973 | Hong et al. | 340/825.76 |
| 4,250,432 | 2/1981 | Kohler | 315/291 |
| 4,270,171 | 5/1981 | Maples et al. | 364/480 |
| 4,514,817 | 4/1985 | Pepper et al. | 364/480 |
| 4,526,078 | 7/1985 | Chadabe | 84/602 |
| 4,707,845 | 11/1987 | Krein et al. | 178/19 |
| 4,833,592 | 5/1989 | Yamanaka | 364/138 |
| 4,922,061 | 5/1990 | Meadows et al. | 178/19 |
| 5,088,929 | 2/1992 | Chan | 434/339 |
| 5,327,160 | 7/1994 | Asher | 345/156 |

*Primary Examiner*—Edward Lefkowitz
*Assistant Examiner*—Davetta Woods
*Attorney, Agent, or Firm*—Young & Thompson

[57] ABSTRACT

A signal control apparatus includes an electrically resistive strip (4) allowing close proximity of a finger. A signal can be coupled into the strip, and a signal output (V1) can be detected at one end of the strip. The structure (1, 3) for coupling a signal into the strip (4) produces a high frequency signal in the strip and a signal output (V2) can be detected at the other end of the strip. These outputs (V1, V2) are dependent, in use, on the position along the strip of a finger in close proximity thereto and provide, by capacitive coupling to the strip (4), a leakage path for some of the signal. The last position of a finger along the strip (4) can be visually indicated when that finger has been removed. The strip (4) is on the underside of an insulating plate (10), the upper side of which has a path (11) for a finger to follow.

6 Claims, 1 Drawing Sheet

VARIABLE VOLTAGE CONTROLLERS

Figure 1:
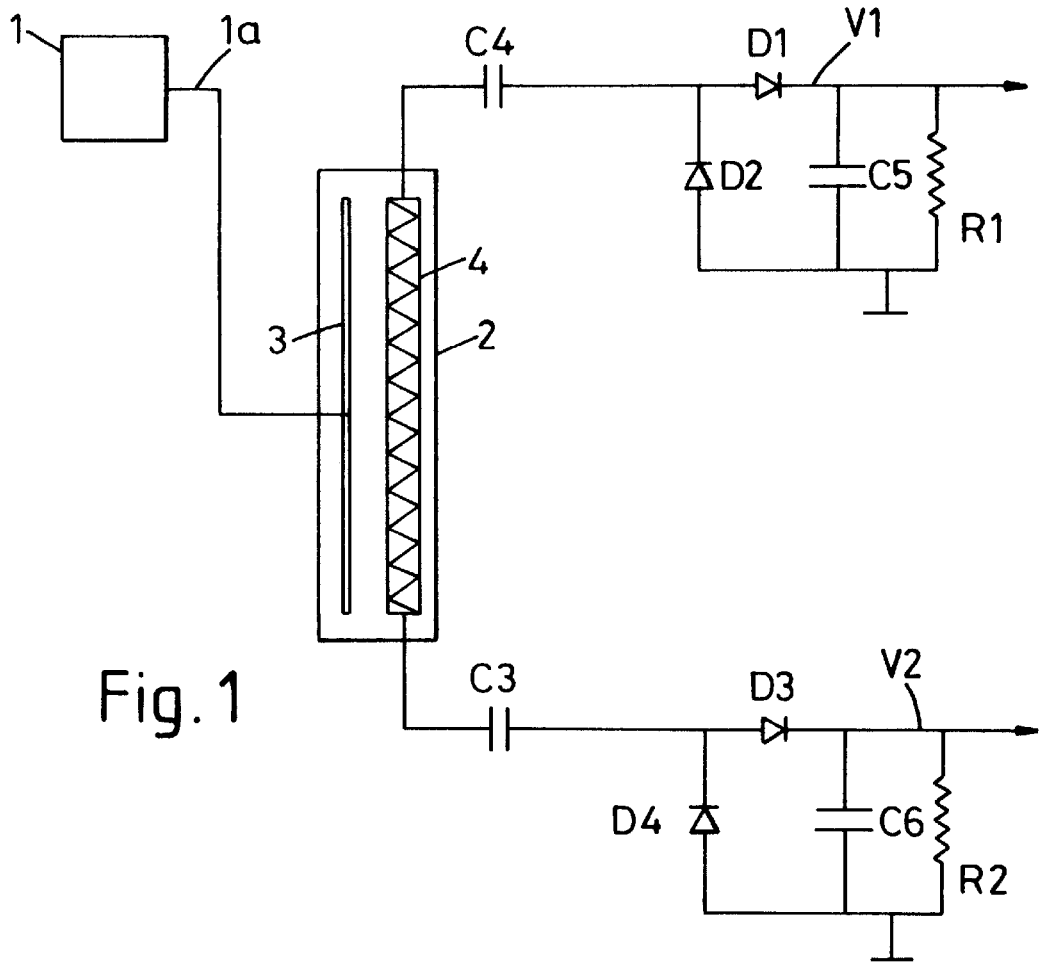

The invention relates to variable voltage controllers. It concerns in particular controllers known as studio faders.

A studio fader is a manually operated control used to change the level of a signal going through it. The fader works in the same way as a volume control on a hi-fi system, except that the control knob moves linearly, rather than rotating. There are numbers along the length of the fader which facilitate accurate positioning of the control knob, but even without such a scale the position of the control knob gives a good visual guide to the effect the fader is having on the signal. For example, with the control knob at the bottom of the fader there would be no output signal. Moving the control up the fader increases the signal until the control is at the very top, where there is maximum signal output.

The main application of faders is in the professional audio and video consoles used in recording studios and in T.V. and radio stations. A fader has two main advantages over a rotary control; the signal level can be precisely controlled with a single finger (leaving other fingers free to control more faders) and the position of the control knob can be more easily seen. This latter point becomes increasingly important in the larger consoles, where the number of faders can be very high (sixty plus). With a complex piece of music, for example, it is a great help to be able to see at a glance the levels of the individual instruments on the fader controls whilst listening to the overall sound.

The standard fader consists of a resistive track, along which is moved a slider having a control knob for manipulation and metal contacts pressing against the resistive track. The moving parts are subject to wear and friction, and binding may occur with use. This results in an ill-defined force being needed to operate each controller leading to unpredictable movement of the control knobs and, therefore, to unpredictable changes in the signal levels. As most controller applications require precise control of the signal level, this is far from optimum.

Fader automation can be provided to assist the operator. During a first mixing operation (where signals from many faders are mixed together) the automation system remembers any change in position of any fader. Each slider is motorised and the motor is driven by the automation system so that, in following mixing operations, the faders repeat their original movements, just as though they were being manually operated. The control knob positions are effective indications . This leaves the operator's hands free to select just those faders which need re-adjustment during the mixing process. This is a good system, but can be expensive.

Alternatively, the fader positions are shown on a display screen, but it is difficult to relate quickly and exactly which image on the screen corresponds to which fader on the console.

It is the aim of this invention to avoid the difficulties and expense of a mechanical controller and the problems of a display screen.

According to the present invention there is provided signal control apparatus comprising an electrically resistive strip capable of being touched by or of being in close proximity to a finger, means for coupling a signal into the strip, and means for detecting the signal outputs at each end of the strip, these outputs being dependent, in use, on the position along the strip of a finger in contact therewith, or in close proximity thereto, and providing a leakage path for some of the signal.

It will be understood that, in this specification, the term 'finger' is used to indicate not just a human digit but anything that an operator can use to slide up and down a resistive strip. A finger is the most readily available instrument and hence is taken as an example throughout.

Preferably, there will be means for indicating the last position of a finger along the strip when that finger has been removed. This facilitates the return of the finger to that position and thus a smooth transition to further control movement.

The signal coupled to the strip may be high frequency, and the leakage path is then provided by the capacitive coupling between the finger and the strip. The strip may then be on the underside of an insulating plate, the upper side of which has a path for a finger to follow.

Alternatively, the signal coupled to the strip may be D.C. and the finger then provides a current leakage path.

It will be advisable to include means for distinguishing between a finger present and a finger absent condition and for suppressing or ignoring the outputs when no finger has been applied to the strip. When no finger has been applied, there will be stable outputs at a given level from the detecting means. The application of a finger anywhere on the strip will cause a drop in those outputs, and this can be used for distinguishing the two conditions.

A finger touching the strip (or in close proximity to it) causes the signal to drain away from each end of the strip, the amount in each direction depending (amongst other things) on the finger's position along the strip. The ratio of the two detected signals indicate the finger's position along the strip, and this positional information can be used to control a main signal which the apparatus is to govern. For example, it can control an external amplifier which varies the amplitude of a signal passing through it.

The amount of signal drain from each end of the strip will vary with size of finger, pressure, temperature, humidity and proximity to the strip. It would therefore not be reliable to take just the signal level as true positional information, However, compensation for these unwanted variables can be achieved by calculating the ratio between the changes in signals measured at both ends of the strip.

For example, a large change in signal level at the top end of the'strip, with a small change in signal level at the bottom of the strip, indicates that the finger is positioned closer to the top than to the bottom. The ratio between these values will indicate the exact position along the strip. If the pressure at that point is changed, or the finger is replaced by another digit, the changes in signal levels at each end will vary, but the ratio (and therefore the indicated position) will remain the same.

It may be prudent to provide a further strip surrounding the first strip and also having a signal coupled into it and associated detecting means. These will be responsive to a signal leakage medium adjacent or touching the further strip to render circuitry associated with the first strip inoperable. In effect, this is an electronic guard rail that shuts down normal operation if, for example, a hand is placed across the fader.

Figure 2:
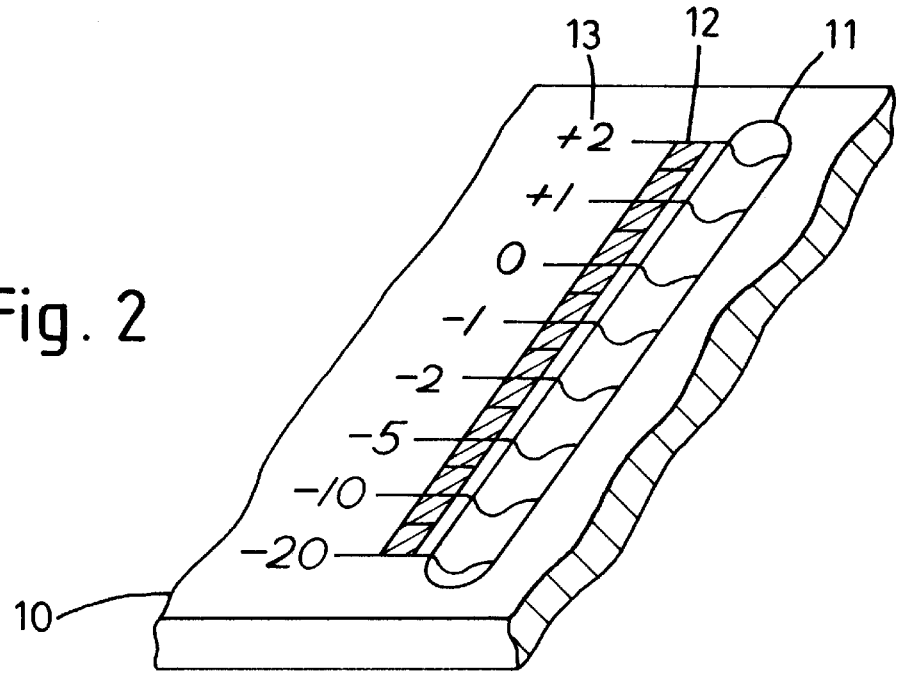

For a better understanding of the invention, some embodiments will now be described, by way of example, with reference to the accompanying drawing, in which:

FIG. 1 is a diagram of electronic circuitry associated with a fader for ascertaining a finger position, and FIG. 2 is a perspective view of a finger operated fader.

In FIG. 1, a high frequency oscillator 1 provides a signal via line 1*a* to a linear fader 2, basically of known form but without a slider. The signal energises the wiper track 3, and the proximity of this to a resistive strip 4 results in the high frequency signal being induced in the strip 4. The signals generated at both ends of the strip 4, which will vary according to the position of an applied finger as described above, are rectified by substantially similar diodes D1, D2, D3, D4, and substantially similar capacitors C3, C4, C5, C6 to produce d.c. voltages V1 and V2 across resistors R1 and R2.

The rectified outputs, V1 and V2, can be measured by an analogue to digital convertor of known technology (not shown for simplicity), connected to a microprocessor (also not shown). An alternative embodiment could have the outputs directly connected to analogue circuitry that performs the same function as the convertor and microprocessor.

Positional information is then calculated from the ratio of the two voltages V1 & V2 using the formula below. This position is converted into a voltage that can be used to control the gain of a voltage controlled amplifier (also not shown). The amplifier changes the amplitude level of a sound or video source.

In order to obtain accurate positional information both capacitors C5 and C6 must be allowed to charge up at each position the finger is moved to.

The following formula is used to transform the change in output voltages into an indication of position P related to a scale where 0 represents the end whose output is V1 and 1 the end whose output is V2:

$$P = \frac{dV1}{dV1 + dV2}$$

Where dV1 and dV2 are the changes in voltages at the respective ends.

It might be thought that a finger placed exactly in the centre of the track 4 could not be distinguished from the situation where there is no finger near the track; the ratio of signal outputs at the ends would be the same in both cases. However, the change of those outputs when a finger is placed at the centre makes that condition distinguishable from the 'no finger' condition.

FIG. 2 shows how the fader assembly appears to the user. A base plate 10, made of plastics or similar non-conductive material, would normally carry many controllers side by side, but for simplicity only one is shown. A straight groove 11, the width of an average finger, is cut into the plate 10. The groove is of similar length to the fader element 2, is of arcuate cross-section and has smoothly rounded ends. Along one side the groove 11 is a column of light emitting diodes (LEDs) 12.Beside the LEDs is a numbered scale 13. This indicates the effective attenuation of the controller, and is calibrated in suitable units.

The actual fader 2 and associated electronics can be mounted on a printed circuit board (not shown) and fixed to the underside of the plate 10, with the resistive track 4 flush with the underside of the plate 10, and directly underneath the groove 11. Alternatively, the plate 10 could serve as the circuit board, with all the components mounted directly on its underside.

The position of a finger on the controller can be indicated by the illumination of one of the LEDs 12. When the finger is moved along the controller the LEDs track the movement by illuminating sequentially and one remains on at the position at which the finger is removed. The LEDs are switched by means of known technology using the positional information, and from this is calculated the correct LED or group of LED's that should be illuminated. A memory circuit can store this information so that the LED indicating the last position is kept switched on, even after removal of power.

An alternative to discrete LEDs is an LED bar.

The above description has been confined to a linear controller. The technique can be utilised for any shape of controller by varying the shape and length of the groove 11 and associated sensor track 4.

Instead of a capacitive coupling, there could be direct current leakage. This would require contact between a finger and the strip 4 which would have to be on the upper side of the plate 10. A d.c. signal would be applied to the strip and the finger would act as a current leakage path. The bleed currents at opposite ends would be measured, and the same general principles would apply.

There could be false operation if something more than a finger was placed on a fader. For example, a complete hand or an arm resting on the plate 10 would cover too much of it, and might spread over adjacent faders. Therefore, it is proposed to place an electronic guard rail around each conductor and energise it in the same way as the strip 4 itself. This rail would connect to circuits identical to those connected to each end of the faders. A signal is generated if the user lays a hand or arm across the guard rail, and this is used temporarily to switch off the positioning electronics of all faders which have their guard rails activated. However, their memories of where the last finger positions were will not be wiped, and when the hand or arm is removed normal operation can be resumed.

In practice with capacitive leakage, the guard rail will be a conductive strip on the underside of the plate 10 in an almost closed loop around the strip 4. In a console, each strip 4 will preferably have its own guard rail.

I claim:

1. Signal control apparatus comprising a single electrically resistive strip allowing close proximity but not contact by a finger, means for coupling a signal into the strip to produce a high frequency signal therein, means for detecting the outputs at both ends of the strip, and means for calculating the ratio between the changes in those outputs caused by the proximity of a finger to the strip providing a capacitive leakage path, the ratio being indicative of the position of the finger along said strip.

2. Signal control apparatus as claimed in claim 1, characterised in that the strip (4) is on the underside of an insulating plate (10), the upper side of which has a path (11) for a finger to follow.

3. Signal control apparatus as claimed in claim 1, and including means for distinguishing between a finger present and a finger absent condition and for suppressing or ignoring the outputs when no finger has been applied to the strip.

4. Signal control apparatus as claimed in claim 1, and including a further strip surrounding the first strip and also having a signal coupled into it and associated detecting means, these being responsive to a signal leakage medium adjacent or touching the further strip to render circuitry associated with the first strip inoperable.

5. Signal control apparatus as claimed in claim 1, characterised in that a plurality of resistive strips are mounted on a common base, each with associated coupling and detecting means.

6. Signal control apparatus as claimed in claim 1, and further comprising means (12) for visually indicating the last position of a finger along the strip (4) when that finger has been removed.

* * * * *